United States Patent [19]

McMillen

[11] Patent Number: 5,052,421

[45] Date of Patent: Oct. 1, 1991

[54] TREATMENT OF ALUMINUM WITH NON-CHROME CLEANER/DEOXIDIZER SYSTEM FOLLOWED BY CONVERSION COATING

[75] Inventor: Mark W. McMillen, Oxford, Mich.

[73] Assignee: Henkel Corporation, Ambler, Pa.

[21] Appl. No.: 560,478

[22] Filed: Jul. 27, 1990

Related U.S. Application Data

[63] Continuation of Ser. No. 374,992, Jul. 7, 1989, abandoned, which is a continuation-in-part of Ser. No. 221,065, Jul. 19, 1988, abandoned.

[51] Int. Cl.[5] ..... C23C 22/56; C03C 1/02

[52] U.S. Cl. ..... 134/2; 134/3; 134/28; 134/41; 148/264; 148/275

[58] Field of Search ..... 134/2, 3, 28, 41; 29/DIG. 7; 148/275, 264

[56] References Cited

U.S. PATENT DOCUMENTS

| | | | |
|---|---|---|---|
| Re. 31,198 | 4/1983 | Binns | 134/3 |
| Re. 32,661 | 5/1988 | Binns | 134/3 |
| 1,859,734 | 5/1932 | George | 134/3 |
| 2,613,141 | 10/1952 | Cochran | 134/3 |
| 2,678,876 | 5/1954 | Burnside | 134/3 |
| 2,719,079 | 9/1955 | Murphy | 134/3 |
| 2,819,192 | 1/1958 | Young | 148/275 |
| 2,867,514 | 1/1959 | Newhard | 134/3 |
| 2,883,311 | 4/1959 | Halpert | 134/3 |
| 2,965,521 | 12/1960 | Bomberger et al. | 134/3 |
| 2,976,193 | 3/1961 | Pimbley | 148/275 |
| 3,140,203 | 7/1964 | Grunwald | 134/3 |
| 3,275,562 | 9/1966 | Smith | 252/147 |
| 3,510,430 | 5/1970 | Mickelson | 252/79.1 |
| 3,622,391 | 11/1971 | Baldi | 134/3 |
| 3,645,790 | 2/1972 | Burden et al. | 134/3 |
| 3,646,946 | 3/1972 | Ford et al. | 134/3 |
| 3,663,327 | 5/1972 | Ritzi | 134/3 |
| 3,728,188 | 4/1973 | Yarrington | 156/22 |
| 3,898,095 | 8/1975 | Berdan et al. | 134/3 |
| 3,903,244 | 9/1975 | Winkley | 134/3 |
| 3,905,907 | 9/1975 | Shiga | 134/27 |
| 4,009,115 | 2/1977 | Binns | 134/3 |
| 4,022,703 | 5/1977 | Bakes et al. | 134/3 |
| 4,116,853 | 9/1978 | Binns | 134/3 |
| 4,124,407 | 11/1978 | Binns | 134/3 |
| 4,370,173 | 1/1983 | Dollman | 134/3 |
| 4,435,223 | 3/1984 | Dollman | 134/3 |
| 4,451,304 | 5/1984 | Batiuk | 148/275 |
| 4,459,216 | 7/1984 | Nakazato et al. | 252/79.4 |
| 4,510,018 | 4/1985 | McGowan | 134/3 |
| 4,545,918 | 10/1985 | Pralus | 134/3 |
| 4,608,091 | 8/1986 | Sullivan et al. | 134/3 |
| 4,728,456 | 3/1988 | Yamasoe et al. | 134/3 |
| 4,746,369 | 5/1988 | Sullivan et al. | 134/3 |
| 4,762,638 | 8/1988 | Dollman et al. | 134/2 |
| 4,770,808 | 9/1988 | McDonough et al. | 134/3 |

FOREIGN PATENT DOCUMENTS

| | | |
|---|---|---|
| 2100757 | 6/1982 | United Kingdom . |

*Primary Examiner*—Patrick P. Garvin
*Assistant Examiner*—G. Fourson
*Attorney, Agent, or Firm*—Ernest G. Szoke; Wayne C. Jaeschke; Daniel S. Ortiz

[57] ABSTRACT

The invention is a metal treating process which uses a chrome-free deoxidizing bath. The process is useful for cleaning and deoxidizing aluminum substrates followed by conversion coating of the cleaned and deoxidized substrates.

22 Claims, No Drawings

TREATMENT OF ALUMINUM WITH NON-CHROME CLEANER/DEOXIDIZER SYSTEM FOLLOWED BY CONVERSION COATING

RELATED APPLICATION

This application is a continuation of application Ser. No. 07/374,992, filed on July 7, 1989, now abandoned, which is a continuation-in-part of Ser. No. 07/221,065, filed on July 19, 1988, now abandoned.

FIELD OF THE INVENTION

This invention relates to a novel process for cleaning and deoxidizing aluminum prior to conversion treatment. The process is based on an acid or alkaline cleaning system and a chromate-free deoxidizer system.

BACKGROUND OF THE INVENTION

Traditionally, chromated deoxidizers have been used to enable aluminum samples to pass designated corrosion tests, as for example, MIL-C-5541C. The aluminum is first cleaned in a relatively non-etching alkaline soak cleaner, deoxidized in an acidic chromate solution and subsequently chromated. Alternatively, if etching was desired, an alkaline etch or alkaline chemical milling solution was used. This step was followed by a deoxidation step which usually employed a chromated deoxidizer, to remove "smut" produced by etching. The aluminum was then chromated. In the past, attempts to replace chromate in the deoxidizing step have generally involved the use of iron salts such as ferric sulfate. However, iron based deoxidizers have never provided results equal to the chromate containing deoxidizer systems.

U.S. Pat. No. 4,451,304 to Batiuk provides a treatment for aluminum which employs an alkaline cleaning step and a deoxidizer step. The deoxidizer step employs a non-chromate deoxidizer which is an aqueous solution of sodium or potassium nitrite. This patent, which is incorporated herein by reference, includes a detailed discussion of the prior art in this area.

Other than in the operating examples and claims, or where otherwise indicated, all numbers expressing quantities of ingredients or reaction conditions used herein are to be understood as modified in all instances by the term "about".

DESCRIPTION OF THE INVENTION

The present invention is advantageous in that it eliminates the use of hexavalent chromium in the cleaning and deoxidizing step and further provides enhanced performance over previously disclosed non-chromium processes for the cleaning and deoxidizing of aluminum prior to chemical conversion treatments.

In accordance with the present invention, aluminum is cleaned in an aqueous acidic or alkaline solution. The preferred acidulants are acids such as sulfuric acid, nitric acid, hydrofluoric acid, phosphoric acid, citric acid, oxalic acid, acetic acid, gluconic acid, hydroxyacetic acid and the like or mixtures of two or more such acids. Preferably the acidic solution is a dilute solution which provides low etching.

The alkaline cleaning solutions useful in the present invention generally contain alkali metal hydroxides or other water soluble alkaline materials such as trisodium phosphate, alkali silicates, tetrasodium pyrophosphate and the like.

The etchants can also comprise acidic solutions of fluoride compositions such as hydrogen fluoride and fluoride salts, fluoride complexes and the like, such as ammonium bifluoride, fluorosilicic acid, fluorophosphonic acid, its salts, and the like.

Following the cleaning step, the aluminum is then immersed in an aqueous acidic deoxidizer solution containing at least one of the following deoxidizer compositions hydrogen peroxide or heteropoly vanadic acids or its salts. Optionally, the aluminum can be rinsed before contact with the deoxidizer solution. The use of a rinse is preferred.

In another embodiment of the invention the aluminum article can be cleaned and deoxidized in a single step by including a deoxidizer compound such as hydrogen peroxide in the acid cleaning solution.

DETAILED DESCRIPTION OF THE INVENTION

In the description of the invention, the term "aluminum" used in connection with the substrate metal to be treated, includes aluminum metal per se and also those aluminum alloys which are generally subjected to a cleaning and deoxidizing treatment prior to chromating or other chemical or electrochemical conversion treatment.

Aluminum metal per se invariably contains trace impurities of other metals. Exemplary of such impurity metals are copper, manganese, nickel, zinc, titanium, vanadium, sodium and gallium.

Aluminum alloys generally contain larger amounts of other metals. Such alloying metals include silicon, chromium, lead, iron, copper, magnesium, manganese, zinc and the like.

Such metals in the form of ions as well as aluminum ions invariably are present in the deoxidizer solutions by virtue of the action of such solutions on the metal and smut. It is one aspect of the present invention that the deoxidizer solutions containing stabilizers can continue to function in the presence of such other metal ions, particularly iron, copper and manganese. The multivalent metal ions tend to catalyze the decomposition of the hydrogen peroxide component. This is especially true with copper and manganese.

In respect to the first step of this invention the aluminum substrate is subjected to cleaning and/or etching preferably with a dilute aqueous acidic solution at a pH of less than 2.

Preferably the pH is below 2 and most preferably below 1.5. The cleaning solutions generally contain from 0.005% to 5% by volume or 10% by weight of the acids but can contain up to about 50% by weight, and preferably from about 0.2 to about 8% by weight and more preferably from about 0.4% to about 2.5% by volume. It is also preferred to employ a mixture of acids such as sulfuric acid and hydrofluoric acid.

While optional, suitable surfactants can be included in the cleaning solutions. They can be used in amounts of from 0% to 5% by weight, and preferably up to about 2% and most preferably up to about 0.5% by weight. Any suitable surfactants which are compatible with the cleaning solution and do not leave an undesirable film on the aluninum's surface can be used. Such surfactants include the cationic, anionic, amphoteric and nonionic surfactants.

The cleaning and/or etching step can be done in an alkaline cleaner etching solution. Known alkaline cleaning solutions which contain alkali metal hydroxide, alkali metal carbonate, trialkali metal phosphate (such as trisodium phosphate) tetralkali metal pyrophosphate (tetrasodium pyrophosphate) alkali metal silicates and the like, alone or in combination can also be used in the cleaning step of the present invention. Alkaline cleaning compositious such as Ridoline ® 53, P3 Almeco ® 18 and Ridoline ® 322 can be used in the cleaning step.

In an alternate embodyment of the invention, an acid cleaning-etching step can be combined with the deoxidizer step by including hydrogen peroxide and a hydrogen peroxide stabilizer with an acid cleaning solution. The combined cleaning and deoxidizing steps can be carried out at a temperature of from about ambient to about 170° F. and preferably from about 90° F. to about 150° F. The pH of the solution is preferably below about 3 and more preferably below about 1.5 and most preferably below about 0.5.

It will be appreciated that the cleaning-etching step can be conducted in a short period of time with substantially little etching or can be continued for a longer period of time if a deeply etched surface is desired.

It will also be appreciated that the cleaning-etching step can be conducted at ambient temperatures but it is preferred to conduct the cleaning step at elevated solution temperatures. Higher temperatures increase the rate of cleaning and/or etching action of the cleaner solution and a certain degree of care must be exercised to ensure that the desired degree of cleaning or etch is obtained. The temperature of the cleaning/etching solution is preferably from about 90° F. to about 175° F. and most preferably from about 100° F. to about 150° F.

In respect to the deoxidizing step, it is preferred that the deoxidizer bath be acidic and preferably be below a pH of 4, and more preferably at or below 2. When the heteroploy ions are employed in the deoxidizer bath, they can be added to the bath as such or can be generated in situ from their components.

When heteropoly vanadic acid or its salts are used, the deoxidizer comprises from 0.1 gram/liter to the solubility limit of the material and an acid to form a composition having a pH below 3. Generally, mineral acids are used and nitric acid is preferred.

When the deoxidizer is hydrogen peroxide, it is preferred that the solutions contain from 0.03 to 30% by weight hydrogen peroxide and it is further preferred that one or more stabilizers for hydrogen peroxide also be employed in the solution. With respect to hydrogen peroxide deoxidizer solutions, it is also preferable to adjust the pH to about 3 or less and preferably with nitric acid. The pH is preferably not greater than 1.5 and most preferably 0.5 or below. The deoxidizer solution is preferably maintained at a temperature from about ambient to about 150° F. depending on the time the aluminum article is in contact with the solution.

The aluminum article preferably is in contact with the deoxidizer solution from about 1 to about 25 minutes. The contact time is generally shorter at higher temperatures.

Stabilizers for peroxides are well known and are exemplified in U.S. Pat. No. 4,509,678. This patent is incorporated herein by reference. Other suitable stabilizers for hydrogen peroxide are well known in the art and any of these can be conveniently used provided they are compatible with acidic solutions. A preferred group of stabilizers is disclosed in U.S. patent application Ser. No. 07/221,063 filed on July 19, 1988, now abandoned, in the name of Mark McMillen and entitled "Stabilization of Peroxide Solutions.

After the deoxidation treatment, the treated aluminum substrate is then chromated by chromating treatments for aluminum, which are well known in the art. Chromating with chromating compositions such as Alodine ® 1200S or Alodine ® 600 product of Parker-+Amchem a division of Henkel Corporation are useful. The aluminum substrates are preferably rinsed before being treated with the chromating compositions. Rinsing is preferred to reduce contaminatin of the chromating composition with the components of the deoxidizing treatment composition.

The examples which follow are intended to illustrate this invention and are not to be considered limiting.

EXAMPLE 1

A cleaning solution was prepared as follows:

A. 70 mls of a solution prepared by diluting 323 mls of 96% sulfuric acid with water to one liter.

B. 70 mls of hydrofluoric acid concentrate solution prepared by diluting 214 grams of 70% hydrofluoric acid to one liter. 70 mls A and 70 mls B were mixed and diluted to 7 liters with a mixture of 25% Ambler Borough (Pa.) tap water and 75% deionized water. The mixture of tap water and deionized water had a conductance of 250 micromhos.

A deoxidizer solution was prepared as follows: A concentrate was first prepared by blending 3800 mls of 35% hydrogen peroxide and 200 mls of Dowfax ® 241 (sodium dodecyl diphenyl oxide disulfonate).

1610 mls of the hydrogen peroxide concentrate as prepared above and 475 mls of 70% nitric acid were diluted to 18.9 liters.

Panels of aluminum alloy 2024-T3 were immersed in the cleaning solution at a temperature of 120° F. for a period of ten minutes. The panels were then removed, rinsed with deionized water and immersed in the deoxidizer solution at ambient temperature for 15 minutes. The panels were rinsed and subsequently chromated. The chromated panels successfully passed MIL-C-5541C test for neutral salt spray specifications. The MIL-C-5541C specification and test methods are incorporated herein by reference.

EXAMPLE 2

A cleaner solution concentrate was prepared by blending 100 mls of 96% sulfuric acid and 416 mls of 75% phosphoric acid and diluting to one liter.

A cleaner solution was prepared by mixing 140 mls of cleaner solution and 70 mls of hydrofluoric acid solution concentrate as prepared in Example 1 and diluting to 7 liters. The deoxidizer solution used in this example was identical to that used in Example 1.

Panels of aluminum alloy, 2024-T3, were immersed in the above cleaning solution at a temperature of 120° F. for a period of 10 minutes. Thereafter the panels were removed, rinsed with water and immersed in the deoxidizer solution at ambient temperatures for a period of 15 minutes. Thereafter, the panels were rinsed and chromated. These panels passed the MIL-C-5541C neutral salt spray specifications.

EXAMPLE 3

A cleaner concentrate solution was prepared by blending 256 mls of 96% sulfuric acid, 90 grams of Mirawet ® B (amphoteric surfactant), 90 grams of Surfonic® LF-17 (ethoxylated alcohol) and diluting to one liter with water.

4 liter cleaning baths were prepared containing 50 mls of the cleaner concentrate to which varying amounts of hydrofluoric acid were added as shown in Tables I and II.

The amount of hydrofluoric acid added in the baths set forth in Tables I and II and based on the hydrofluoric acid concentrate as prepared in Example 1. In respect to the 0.17% solutions, 40 milliliters of the hydrofluoric concentrate were added. In respect to the 0.09% solutions, 21 milliliters of the hydrofluoric concentrate were added, and in respect to the 0.009%, 2 milliliters of the hydrofluoric acid concentrate were added.

A 4 liter deoxidizer bath was prepared in a manner similar to that of Examples 1 above. The ingredients employed in the deoxidizer baths are set forth in Tables I and II below.

In respect to the baths exemplified in Table 1, it should be noted that reagent grade 70% nitric acid was used and the stabilizer of Table I was Dowfax® 2Al (sodium dodecyl diphenyl oxide disulfonate). Further in respect to the baths of Table I, 10.2 milliliters of the stabilizer were added to obtain the 0.255% stabilizer concentration and 0.4 milliliters of the stabilizer were added to get the 0.01% stabilizer concentration.

In respect to the peroxide, 400 milliliters of 35% hydrogen peroxide diluted to one liter with water, were used for the 10% concentrations and 240 milliliters were used for the 6% concentrations.

In respect to the deoxidizer baths of Table II, commercial grade nitric acid at 67.5% was employed and the stabilizer was Monofax® 1214 (alkyl phosphate ester). In respect to the nitric acid, 400 milliliters of the nitric acid were used for the 10% solution, 240 milliliters ofr 6% solutions and 80 milliliters for the 2% solutions. Furthermore in respect to the peroxide, 400 milliliters were used for the 10% solution, 240 milliliters for the 6% solution and 80 milliliters for the 2% solution were employed.

TABLE I

| CLEANER | | | DEOXIDIZER | | | |
|---|---|---|---|---|---|---|
| 96% Sulfuric Acid | 70% HF | Surfactant | 35% Peroxide | Stabilizer | pH Adj. w/HNO | Time |
| 0.3% | 0.17% | 0.2% | 6% | 0.255% | 0.5 | 10 Min |
| 0.3% | 0.09% | 0.2% | 6% | 0.01% | 1.0 | 5 Min |
| 0.3% | 0.09% | 0.2% | 6% | 0.255% | 0.5 | 15 Min |
| 0.3% | 0.09% | 0.2% | 10% | 0.255% | 0.5 | 10 Min |

TABLE II

| CLEANER | | | DEOXIDIZER | | | |
|---|---|---|---|---|---|---|
| 96% Sulfuric Acid | 70% HF | Surfactant | 35% Peroxide | Stabilizer | 42° Be HNO | Time |
| 0.3% | 0.17% | 0.2% | 6% | 0.1 g/l | 6% | 15 Min |
| 0.3% | 0.09% | 0.2% | 10% | 2.55 g/l | 6% | 15 Min |
| 0.3% | 0.09% | 0.2% | 10% | 2.55 g/l | 6% | 15 Min |
| 0.3% | 0.09% | 0.2% | 10% | 2.55 g/l | 6% | 5 Min |
| 0.3% | 0.09% | 0.2% | 6% | 2.55 g/l | 6% | 10 Min |
| 0.3% | 0.009% | 0.2% | 2% | 5 g/l | 6% | 10 Min |
| 0.3% | 0.17% | 0.2% | 6% | 2.55 g/l | 10% | 10 Min |
| 0.3% | 0.17% | 0.2% | 6% | 2.55 g/l | 2% | 10 Min |

Aluminum panels of alloy, 2024-T3, were cleaned in a specified cleaner bath set forth in Table I and Table II above. The panels were then rinsed and immersed in the deoxidizer bath as indicated in Tables I and II above, each for a specified period of time listed. After the deoxidizing step, the panels were removed, rinsed and chromated. The chromated panels were then tested in neutral salt spray for 336 hours (twice as long as MIL-C-5541C requires). All panels showed no pitting and no corrosion after testing.

It has been found that preferred systems are those wherein the cleaning solution contains 0.3% by volume sulfuric acid (96%), 0.17% by volume hydrofluoric acid (70%). and up to 0.2% by volume sodium 2-ethyl hexyl sulfate surfactant for a strong etch cleaner. This cleaner should be used for 5–10 minutes at temperatures of from about 110° F. to about 130° F.

It is preferred to then subject the aluminum panels to a deoxidizing step for about 10–15 minutes by immersion in a deoxidizing bath of preferably 8% by volume hydrogen peroxide (35%), 3% by volume (42° Bé) nitric acid and up to 0.5% of a stabilizer for the peroxide (preferably Miratainе® CBS (cocoamidopropyl hydroxy sultaine).

When it is desired to have an etching cleaner with lower etching properties, it is preferred to employ a cleaning solution of 0.5% by volume sulfuric acid (96%), 1.7% phosphoric acid by volume (75%), and up to 0.2% of a surfactant combination which is a mixture of Triton® N-100 and Surfonic® LF-17. This is used at a temperature of from about 110° F. to about 140° F. for 5 to 10 minutes followed by the same deoxidizer step as established above for from about 5 to 15 minutes.

EXAMPLE 4

A cleaner-etching-deoxidizer bath was prepared containing 8% $H_2O_2$, 2.5% $HNO_3$, 1.5% phosphoric acid and 2 ml/liter of Triton® X-102 surfactant (octylphenoxy polyethoxy ethanol). Aluminum panels were immersed in the cleaning-etching deoxidizer solution for 10 minutes at 120° F. The panels were rinsed and then chromated in an Alodine® 1200S chromating solution according to manufacturer's recommendations. The chromated panels were then tested in neutral salt spray for 336 hours. There was no pitting or corrosion of the aluminum panels.

EXAMPLE 5

A cleaner-etching-deoxidizer bath was prepared containing 8% $H_2O_2$, 2.5% $HNO_3$, 1 ml/liter of 79% $HBF_4$ and 2 ml/liter Triton® X-102 surfactant. Aluminum panels were immersed in the cleaner-etching-deoxidizer solution for 10 minutes at 120° F. The panels were rinsed and then chromated in an Alodine® 1200S solution according to manufacturer's recommendations. The chromated panels were then tested in neutral salt spray for 336 hours. There was no pitting or corrosion of the aluminum panels.

The combining of the acid cleaning-etch step with the deoxidizer step into one treating step is an advance in the art. The combining of two steps into a single step reduces the equipment necessary to provide a commercial process and in addition reduces the processing time for each aluminum piece.

I claim:

1. A process for treating an aluminum article which comprises: cleaning the aluminum article by contact with a cleaning solution; deoxidizing the cleaned aluminum article by contact with an acidic deoxidizing solution selected from the group consisting of an acidic, stabilized hydrogen peroxide containing solution; an acidic heteropoly vanadic acid containing solution, or an acidic heteropoly vanadic acid salt containing solution; and conversion coating the deoxidized aluminum article wherein the cleaning and deoxidizing steps may be combined to result in a 2-step process.

2. A process of claim 1 wherein the pH of the acidic stabilized hydrogen peroxide solution is at a pH below about 3.

3. A process of claim 1 which comprises: cleaning the aluminum article by contact with an alkaline cleaning solution, rinsing the aluminum article, and contacting the rinsed aluminum article with the acidic deoxidizing solution.

4. A process of claim 3 wherein the cleaning solution is at a temperature of from about 90° F. to about 175° F.

5. A process of claim 3 wherein the deoxidizing solution is a stabilized hydrogen peroxide solution at a temperature of from about ambient to about 150° F. and at a pH below about 1.5.

6. A process of claim 5 wherein the pH of the stabilized hydrogen peroxide solution is below about 0.5.

7. A process of claim 1 wherein the cleaning step comprises: cleaning the aluminum article by contact with an aqueous acidic solution at a pH below about 2.

8. A process of claim 7 wherein the deoxidizing comprises: contacting the cleaned aluminum article with a stabilized, hydrogen peroxide deoxidizing solution at a pH below about 1.5.

9. A process of claim 8 wherein the pH of the stabilized hydrogen peroxide deoxidizing solution is below about 0.5.

10. A process of claim 7 wherein:

a. the cleaning step comprises contacting an aluminum article with an acidic solution at a temperature of from about 90° F. to about 175° F., at a pH below about 2 for from about 1 to about 15 minutes to clean the aluminum article; and b. the deoxidizing step comprises contacting the cleaned aluminum article with a deoxidizing solution comprising an acidic stabilized hydrogen peroxide solution at a temperature from about ambient to about 150° F. for from about 1 to about 25 minutes.

11. A two step process of claim 1 wherein the combined cleaning and deoxidizing step comprises: contacting an aluminum article with a cleaning-etching-deoxidizing acid stabilized hydrogen peroxide solution at a temperature of from about 90° F. to about 175° F. for from about 2 to about 25 minutes, wherein the pH of the solution is below about 2; followed by conversion coating the deoxidized aluminum article.

12. A process of claim 11 wherein the pH of the cleaning-etching-deoxidizing solution is below about 0.5.

13. A process of claim 11 wherein the cleaning-etching-deoxidizing solution comprises:

a) a deoxidizing effective amount of hydrogen peroxide;

b) a stabilizing amount of a stabilizer for the hydrogen peroxide;

c) a pH adjusting amount of nitric acid; and d) an etching effective amount of a source of fluoride ion.

14. A process of claim 13 wherein the cleaning-etching-deoxidizing solution contains as the deoxidizing agent hydrogen peroxide in an amount from about 0.03% to about 30% by weight hydrogen peroxide.

15. A process of claim 11 wherein the cleaning-etching-deoxidizing solution comprises:

a) a deoxidizing effective amount of hydrogen peroxide;

b) a stabilizing amount of a stabilizer for the hydrogen peroxide;

c) an etching effective amount of phosphoric acid; and d) a pH adjusting amount of nitric acid.

16. A process of claim 11 wherein the conversion coating step comprises contact with a chromate containing conversion coating composition.

17. A process of claim 1 wherein the cleaning step comprises contact with a cleaning solution comprising about 0.3% by volume sulfuric acid (96%), about 0.17% by volume hydrofluoric acid (70%), and up to about 0.2% by weight sodium 2-ethyl hexyl sulfate for a period of about 5 to about 10 minutes at a temperature of from about 110° F. to about 130° F.

18. A process of claim 1 wherein the deoxidizing solution comprises about 8% by volume hydrogen peroxide (35%), about 3% by volume 42°Be nitric acid and wherein the aluminum is immersed in the deoxidizing solution for a period of from about 10 to about 15 minutes at ambient temperature.

19. A process of claim 1 wherein the cleaning step comprises contact with a cleaning solution which comprises about 0.5% by volume sulfuric acid (96%), about 1.7% by volume phosphoric acid (75%), and up to about 0.2% by weight of a surfactant for a period of from about 5 to about 10 minutes at a temperature of about 110° F. to about 140° F.

20. A process of claim 1 wherein the cleaning step comprises contact with an acidic cleaning solution containing up to about 10% by weight of at least one acid and from 0–5% by weight of a surfactant wherein the pH of acidic cleaning solution is less than 2.

21. A process of claim 1 wherein the stabilized hydrogen peroxide solution contains from 0.03% to 30% by weight hydrogen peroxide and is at a pH not greater than 1.5.

22. A process of claim 1 wherein the conversion coating step contact with a chromate containing conversion coating composition.

* * * * *